US006240750B1

(12) United States Patent
Gillespie et al.

(10) Patent No.: US 6,240,750 B1
(45) Date of Patent: Jun. 5, 2001

(54) SECURITY CASE

(75) Inventors: Duane E. Gillespie, Ellis, KS (US); Leung Yiu Ming, Happy Valley (HK)

(73) Assignee: Geoffrey Inc., Wilmington, DE (US)

( * ) Notice: Subject to any disclaimer, the term of this patent is extended or adjusted under 35 U.S.C. 154(b) by 0 days.

(21) Appl. No.: 09/353,991

(22) Filed: Jul. 15, 1999

(51) Int. Cl.[7] ..... E05B 73/00

(52) U.S. Cl. ..... 70/57.1; 70/58; 70/63; 70/161; 206/1.5; 206/308.2; 206/387.11

(58) Field of Search ..... 70/57.1, 387, 58, 70/63, 160–162; 206/1.5, 308.2, 387.11

(56) References Cited

U.S. PATENT DOCUMENTS

| | | | | |
|---|---|---|---|---|
| 845,815 | * | 3/1907 | Pfleger | 70/387 |
| 2,750,787 | * | 6/1956 | Soler Capdevila | 70/387 |
| 2,987,910 | * | 6/1961 | Chi Liang Cho | 70/387 |
| 4,871,065 | | 10/1989 | Hehn et al. | 206/387 |
| 4,966,020 | | 10/1990 | Fotheringham et al. | 70/276 |
| 4,972,690 | | 11/1990 | O'Sullivan | 70/63 |
| 5,289,914 | * | 3/1994 | Holmgren | 292/209 X |
| 5,375,708 | | 12/1994 | Wittman | 206/315.1 |
| 5,375,712 | | 12/1994 | Weisburn | 206/387 |
| 5,390,515 | | 2/1995 | Essick | 70/63 |
| 5,460,266 | | 10/1995 | Mundorf et al. | 206/309 |
| 5,588,315 | | 12/1996 | Holmgren | 70/57.1 |
| 5,597,068 | | 1/1997 | Weisburn et al. | 206/308.1 |
| 5,598,728 | | 2/1997 | Lax | 70/276 |
| 5,680,782 | | 10/1997 | Komatsu et al. | 70/63 |
| 5,760,689 | * | 6/1998 | Holmgren | 70/63 X |
| 5,768,922 | | 6/1998 | Lax | 70/276 |
| 5,782,350 | | 7/1998 | Weisburn et al. | 70/63 X |
| 5,823,341 | | 10/1998 | Nakasuji | 206/387.11 |

* cited by examiner

*Primary Examiner*—Lloyd A. Gall
(74) *Attorney, Agent, or Firm*—Darby & Darby

(57) ABSTRACT

A security device includes a case having at least one through opening. A lid is pivotably connected to the case. The lid pivots between a first open position and a second closed position. The lid has at least one corresponding through opening. In the second closed position, the at least one corresponding through opening in the lid aligns with the at least one through opening in the case. A latch is slidably engaged with the lid. The latch is slidable along a first axis between a first latch position and a second latch position. A locking plate is slidably engaged with the lid. The locking plate is slidable along a second axis between a first locking plate position and a second locking plate position. The locking plate has at least one pin extending along the second axis. In the first locking plate position, the at least one pin extends through the aligned at least one opening in the case and the at least one opening in the lid to lock the lid in the second closed position. In the second locking plate position, the at least one pin is removed from the aligned at least one opening in the case, thereby permitting the lid to pivot between the first open position and the second closed position.

10 Claims, 11 Drawing Sheets

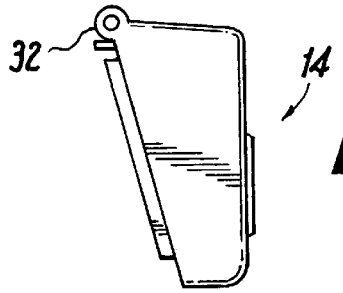
Fig. 9
Fig. 10
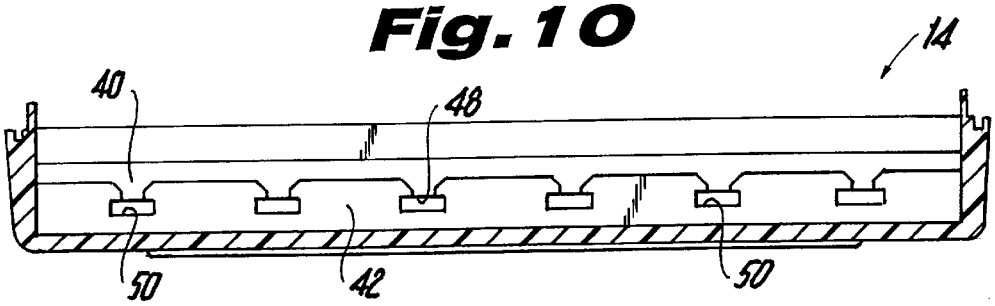
Fig. 11
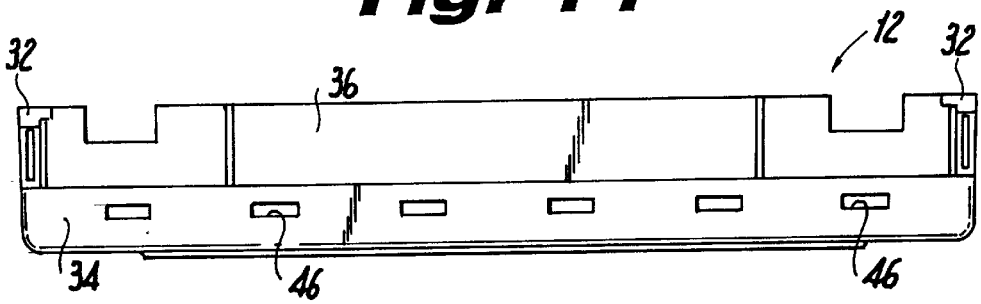
Fig. 12
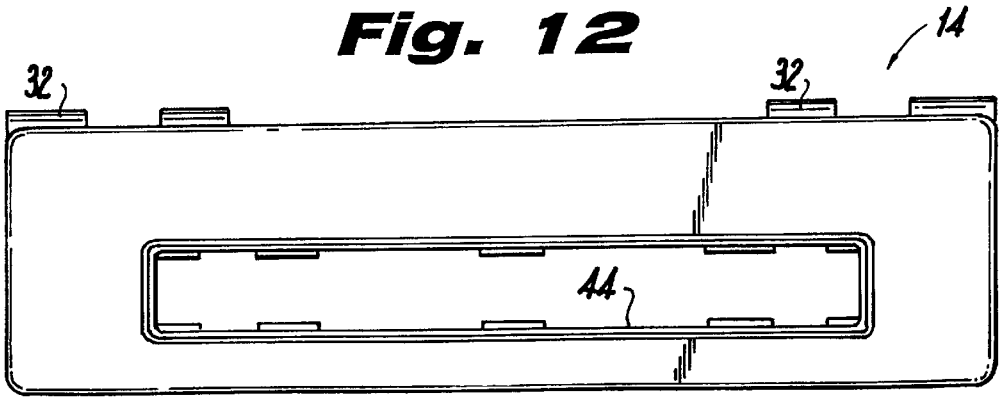

SECURITY CASE

BACKGROUND OF THE INVENTION

1. Field of the Invention

The present invention relates to a security case. More specifically, the present invention relates to a security case for storing articles including, for example, video and audio disks or cassettes.

2. Discussion of the Related Art

Security containers that are opened manually with a specially-shaped key are known, for example, from U.S. Pat. No. 5,375,712 to Weisburn and U.S. Pat. No. 5,390,515 to Essick. These type of security cases have been used in retail stores to display video or audio disks or cassettes. The case is locked to prevent the unauthorized removal of the cassette or disk therefrom, thereby preventing its unauthorized removal from the store.

The containers disclosed in the '515 and '712 patents both utilize a specially-shaped tool or key to unlock the security case. However, when the specially-shaped key is manually inserted into the security case, flexible locking fingers 32 in the '515 patent or flexible tabs 30 through 32 in the '712 patent are flexed into a position where they will no longer interfere with the locking mechanism. Repeated locking and unlocking of either of these locking mechanisms will fatigue the flexible finger or tab. Eventually, the flexible finger or tab will no longer spring back to the locking position, thereby rendering the security container useless.

SUMMARY OF THE INVENTION

Accordingly, it is an object of the present invention to provide a security device for holding a variety of articles, such as, for example, audio and video disks or cassettes, which device can be secured in the locked position and is unlocked by a specially designed key without repeatedly flexing a tab within the locking mechanism.

According to the present invention, this and other objects are achieved, for example, in one exemplary embodiment of a security device that includes a case having at least one through opening. A lid is pivotably connected to the case. The lid pivots between a first open position and a second closed position. The lid has at least one corresponding through opening. In the second closed position, the at least one corresponding through opening in the lid aligns with the at least one through opening in the case. A latch is slidably engaged with the lid. The latch is slidable along a first axis between a first latch position and a second latch position. A locking plate is slidably engaged with the lid. The locking plate is slidable along a second axis between a first locking plate position and a second locking plate position. The locking plate has at least one pin extending along the second axis. In the first locking plate position, the at least one pin extends through the aligned at least one opening in the case and the at least one opening in the lid to lock the lid in the second closed position. In the second locking plate position, the at least one pin is removed from the aligned at least one opening in the case, thereby permitting the lid to pivot between the first open position and the second closed position.

BRIEF DESCRIPTION OF THE DRAWING FIGURES

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein:

FIG. 9 is a left side view of the lid;

FIG. 10 is a cross-sectional view taken along lines 10—10 of FIG. 8 and looking in the direction of arrows;

FIG. 11 is a bottom view of the lid;

FIG. 12 is a front view of the lid;

DETAILED DESCRIPTION OF THE PREFERRED EMBODIMENT

Figure 1:
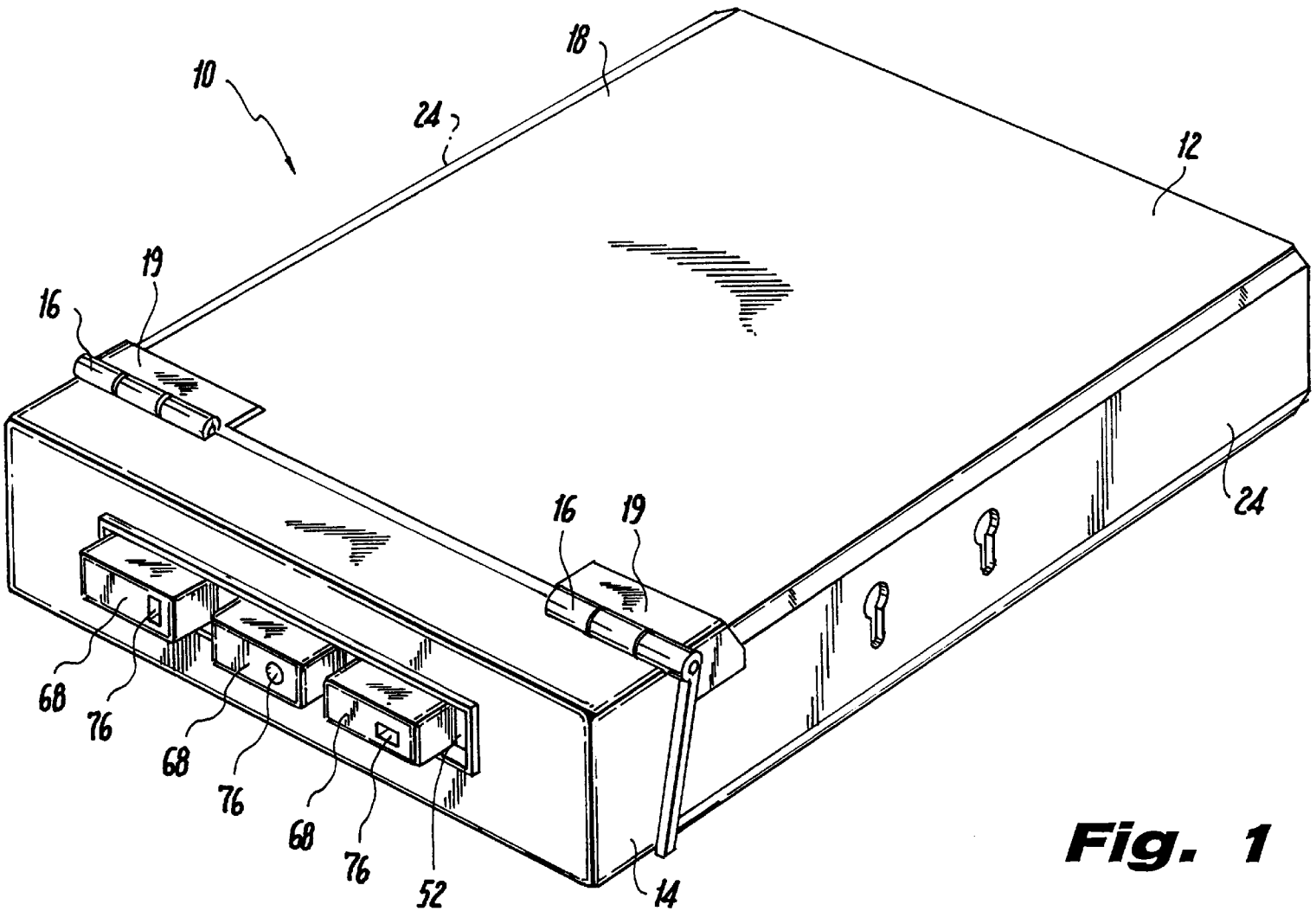
FIG. 1 is a perspective view of the security device shown with the lid in the second closed position in accordance with the present invention.
Figure 2:
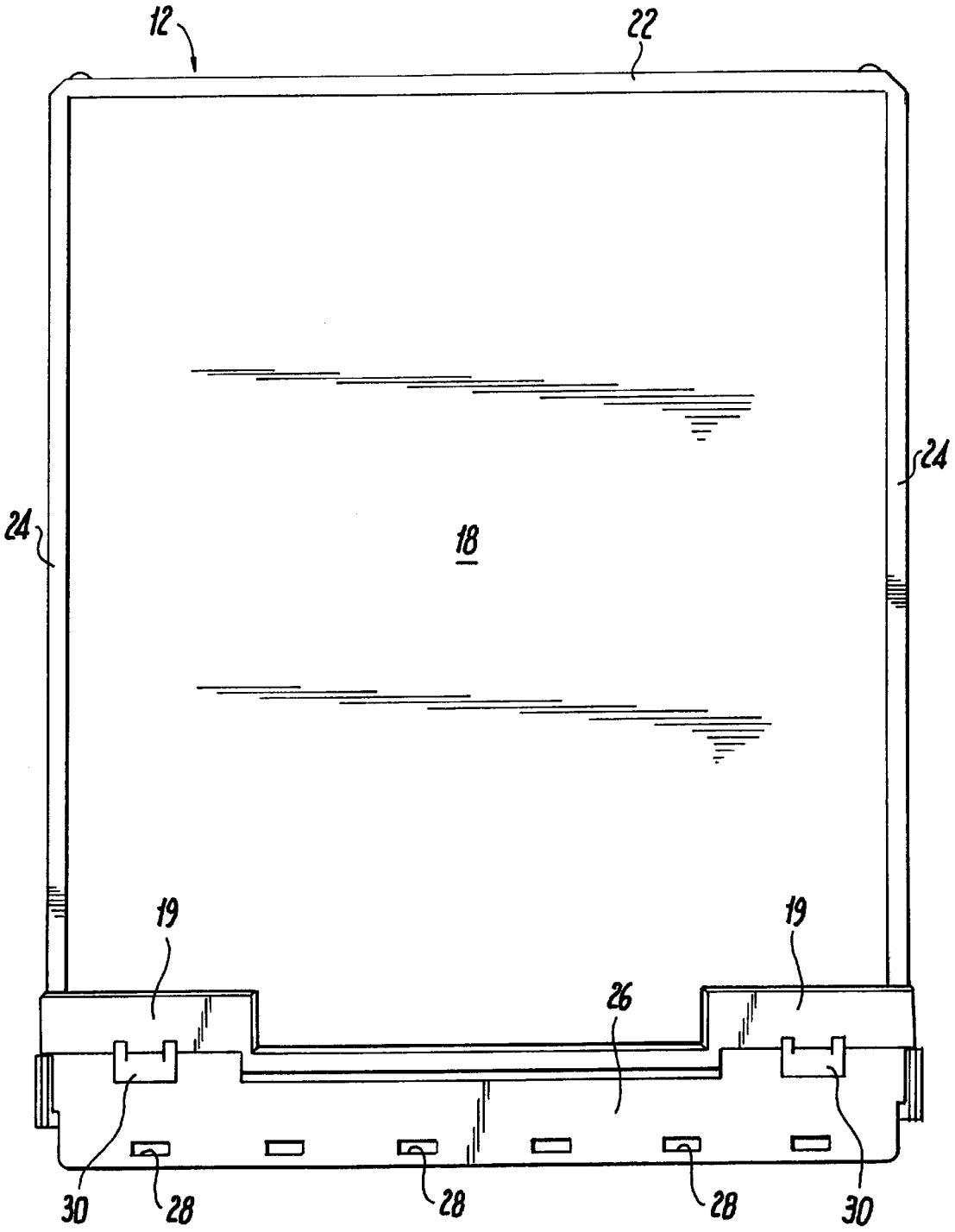
FIG. 2 is a bottom view of the case.
Figure 3:
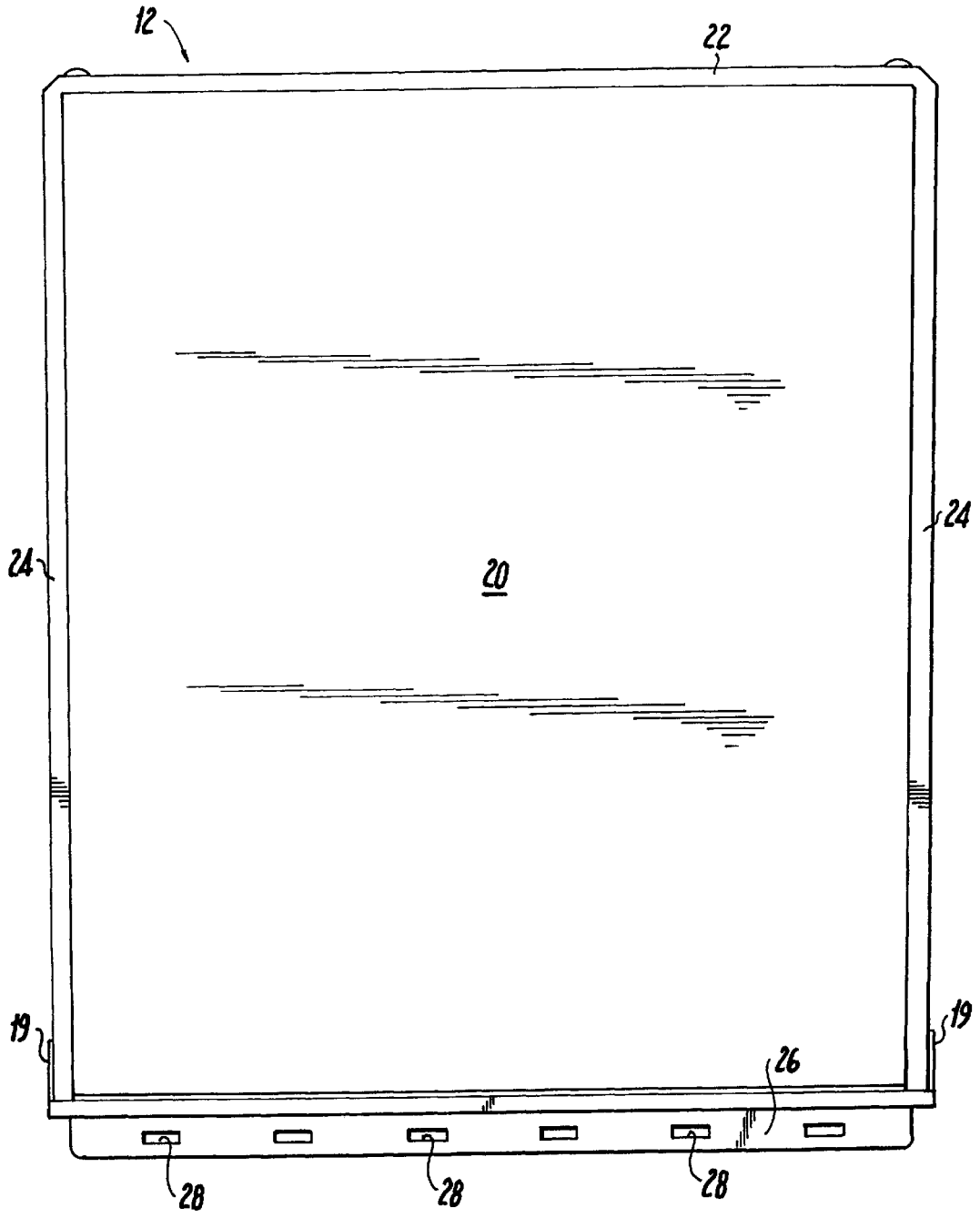
FIG. 3 is a top view of the case.
Figure 4:
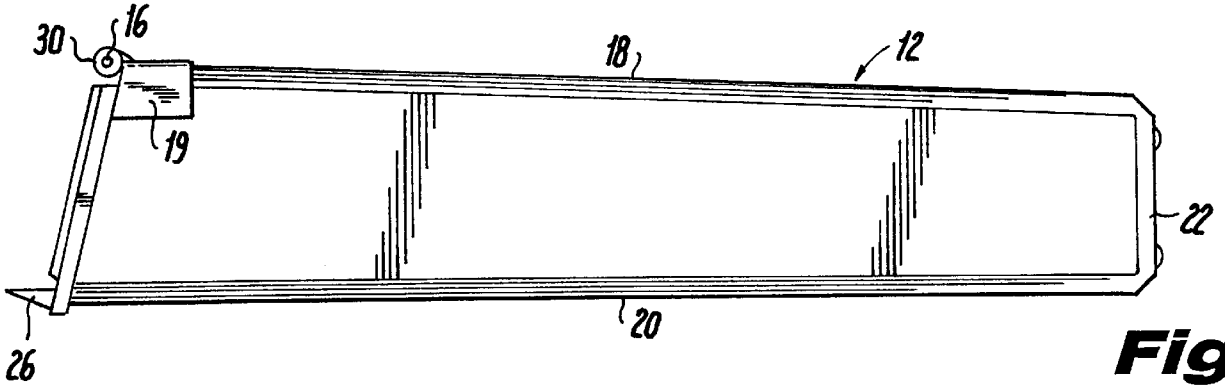
FIG. 4 is a left side view of the case.
Figure 5:
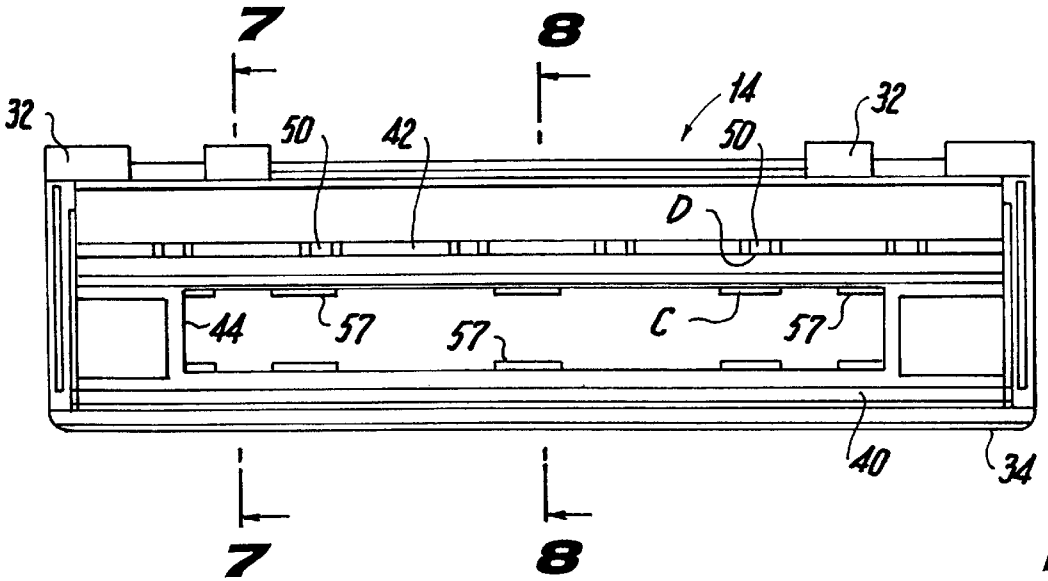
FIG. 5 is a rear view of the lid.
Figure 6:
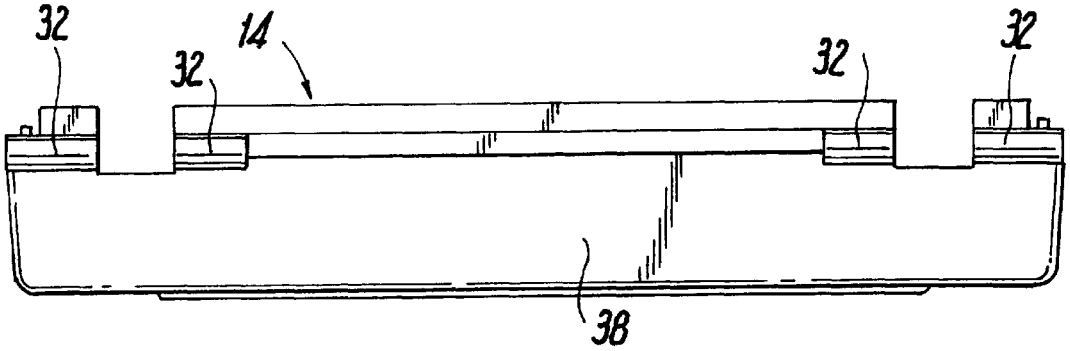
FIG. 6 is a top view of the lid.
Figure 7:
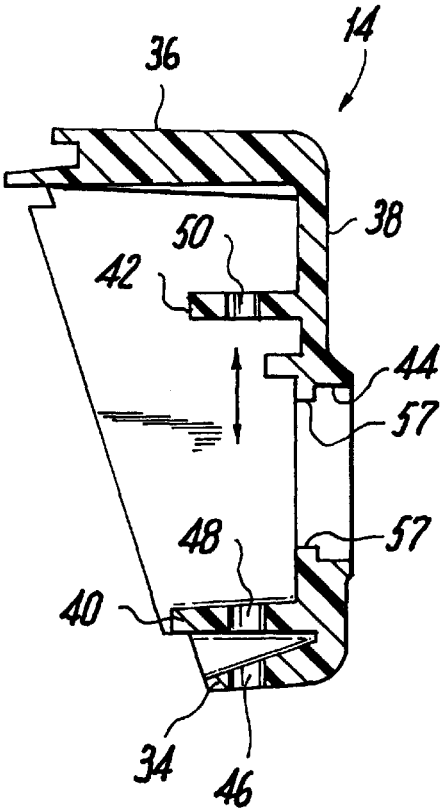
FIG. 7 is a cross-sectional view taken along lines 7—7 of FIG. 5 and looking in the direction of the arrows.
Figure 8:
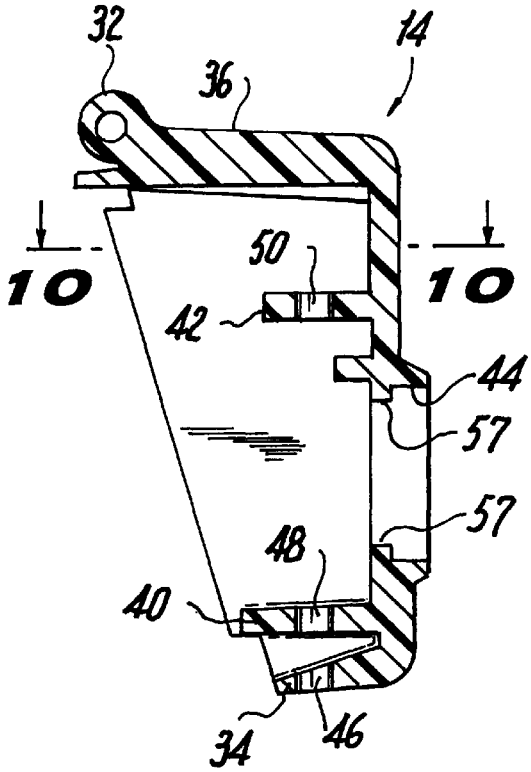
FIG. 8 is a cross-sectional view taken along lines 8—8 of FIG. 5 and looking in the direction of e arrows.

Referring now to FIG. 1, a security device 10, in accordance with the present invention, is illustrated. Device 10 includes a case 12 and a lid 14. Lid 14 pivots with respect to case 12 about coaxial pivot pins 16. Lid 14 pivots between a first open position (not shown in FIG. 1) and a second closed position as illustrated in FIG. 1.

Referring now to FIGS. 1–4, a top view, bottom view and side view, respectively, of case 12 is illustrated. Case 12 has an upper wall 18 and a lower wall 20. Case also includes a bottom wall 22 and a pair of side walls 24. Lower wall 20 includes a forwardly directed flange 26. Flange 26 has a plurality of through openings 28 therein. Case 12 also has a pair of sleeves 30, which receive pins 16 so that lid 14 is pivotally connected to case 12. A portion of upper wall 18 and side walls 24 that is adjacent to sleeves 30 are reinforced with an additional wall thickness 19.

Referring now to FIGS. 5–12, lid 14 is illustrated. Lid 14 includes sleeves 32. Sleeves 32 receive pin 16 so that lid 14 is pivotally connected to case 12. Lid 14 includes a bottom wall 34, atop wall 36 and a front wall 38. A first flange 40 projects inwardly from an inside surface of front wall 38. A second flange 42 projects inwardly from the inside surface of front wall 38. Front wall 38 includes an elongated rectangular-shaped through opening 44. First flange wall 40 is located on one side of through opening 44 and second flange wall 42 is located on an opposite side of through opening 44. Bottom wall 34 includes a plurality of through openings 46 (see FIGS. 7, 8 and 11). First inwardly directed flange 40 also includes a plurality of through openings 48. Second inwardly directed flange wall 42 has a plurality of guide slots 50. One set of through openings 46, 48 and guide slot 50 are aligned with respect to one another along the axis indicated by double-arrow B in FIG. 7. In the illustrated embodiment, there are six sets of aligned through bores 46, 48 and guide slots 50, although more or less sets may be used. When lid 14 is pivoted to the second closed position through openings 46, 48 and guide slot 50 are aligned with a corresponding one of the through openings 28 of flange 26 of case 12, as illustrated in FIGS. 17 and 19.

Figure 17:
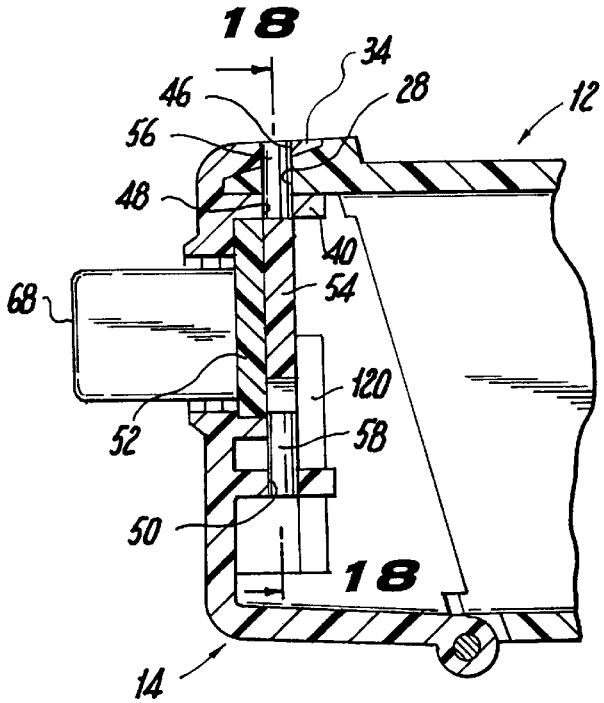
FIG. 17 is a partial cross-sectional view of the lid and case, with the locking plate in the first locking plate position.
Figure 18:
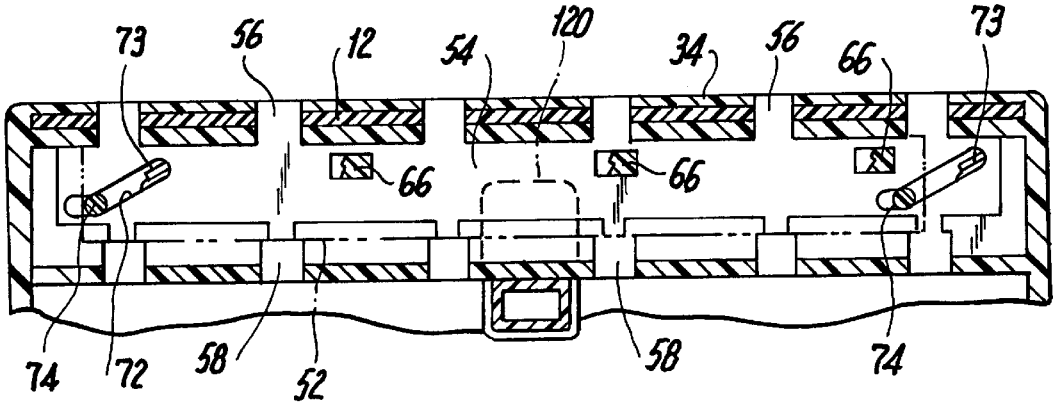
FIG. 18 is a cross-sectional view taken along lines 18—18 of FIG. 17 and looking in the direction of arrows.
Figure 19:
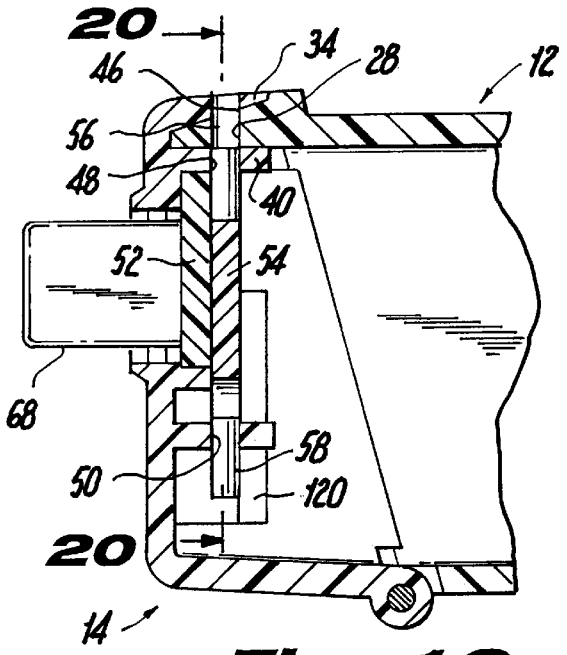
FIG. 19 is a partial cross-sectional view of the lid and case, with the locking plate in the second locking plate position.
Figure 20:
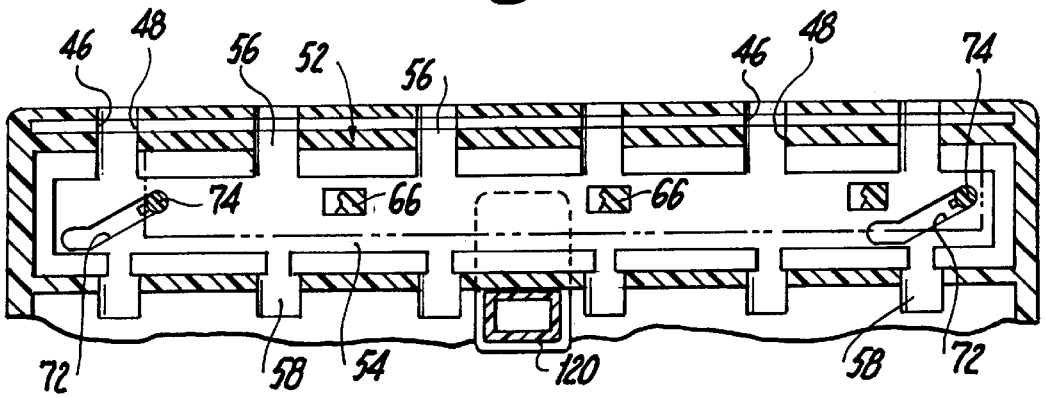
FIG. 20 is a cross-sectional view taken along lines 20—20 of FIG. 19 and looking in the direction of the arrows.

Referring now to FIGS. 1, 13, 14 and 17–20, a latch 52 is illustrated. Latch is slidably connected to lid 14 via a bayonet-type coupling. More specifically, a longitudinal channel is formed by flanges 53, 55. The longitudinal channel is received between flanges 57 of lid 14 (see FIGS. 5 and 7). Latch 14 is slidable along the first axis indicated by double-arrow A in FIG. 14 between a first latch position, as illustrated in FIGS. 1, 17 and 18, and a second latch position, as illustrated in FIGS. 19 and 20.

Referring now to FIGS. 15 and 17–20, a locking plate 54 is illustrated. Locking plate 54 is slidably connected to lid 14. Locking plate 54 is slidable along a second axis, which is indicated by double-arrow B in FIG. 15. Locking plate 54 slides along second axis B between the first locking plate position, as illustrated in FIGS. 17 and 18 and the second locking plate position, as illustrated in FIGS. 19 and 20. As shown in FIGS. 17–20 an L-shaped back plate 120 is fixedly connected to lid 14 to further support the sliding connection between locking plate 54 and lid 14. Locking plate 54 includes a plurality of locking pins 56 projecting from one side of locking plate 54 and extending in the direction of axis B. Axis B 15 is substantially perpendicular to axis A. Locking plate 54 includes a plurality of guide pins 58 projecting from plate 54 from the side opposite that pins 56 project from. Guide pins 58 also extend along axis B. Guide pins 58 are received in guide channels or slots 50 in lid 14 so that locking plate 54 is guided to move only in the direction indicated by double-arrow B. Locking plate 54 moves between a first locking plate position and a second locking plate position. In the first locking plate position, pins 56 extend through the corresponding aligned openings 28 in case 12, which are aligned with corresponding openings 46, 48 in lid 14, thereby locking lid 14 in the second closed position with respect to case 12 (see FIGS. 17 and 18). As shown in FIGS. 19 and 20, in the second locking plate position, pins 56 are removed from at least the corresponding aligned opening 28 in case 12 and, in a currently preferred embodiment, from the corresponding openings 46 and 48 in lid 14, thereby permitting lid 14 to freely pivot between the first open position and the second closed position.

Figure 13:
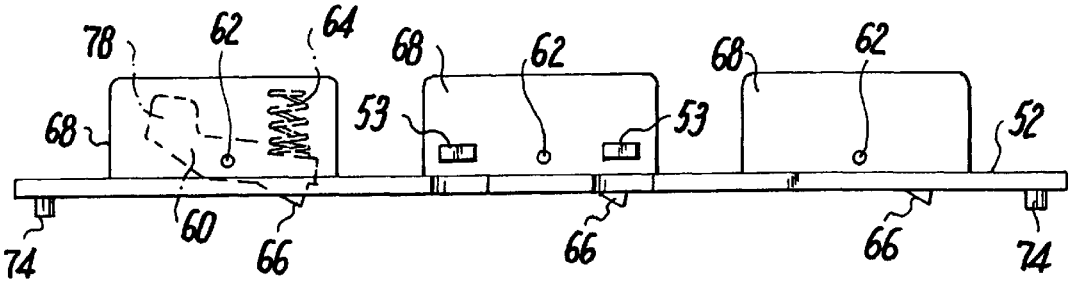
FIG. 13 is a side view of the latch.
Figure 14:
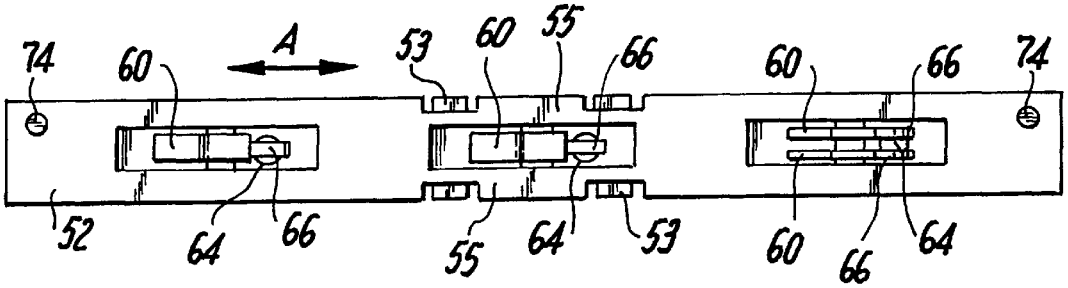
FIG. 14 is a bottom view of the latch.
Figure 15:
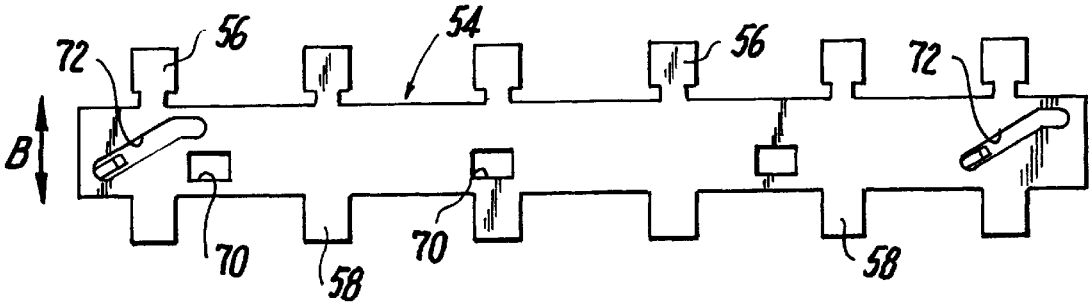
FIG. 15 is a top view of the locking plate.
Figure 16:
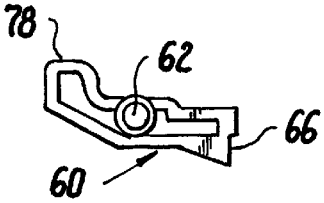
FIG. 16 is a top view of the spring-biased pawl.
Figure 21:
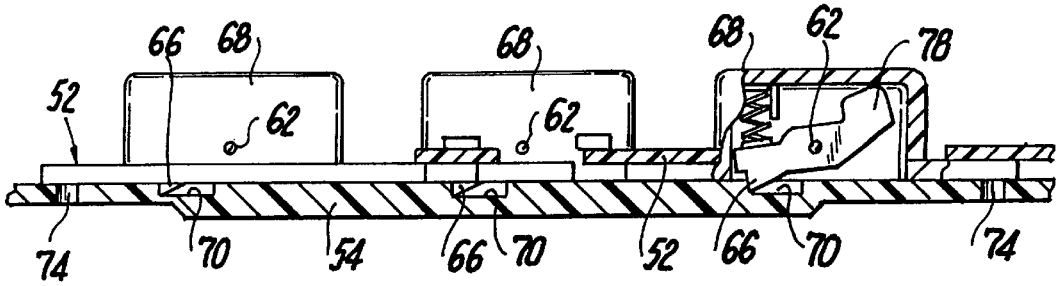
FIG. 21 is a partial cross-sectional view of the latch and locking plate.
Figure 22:
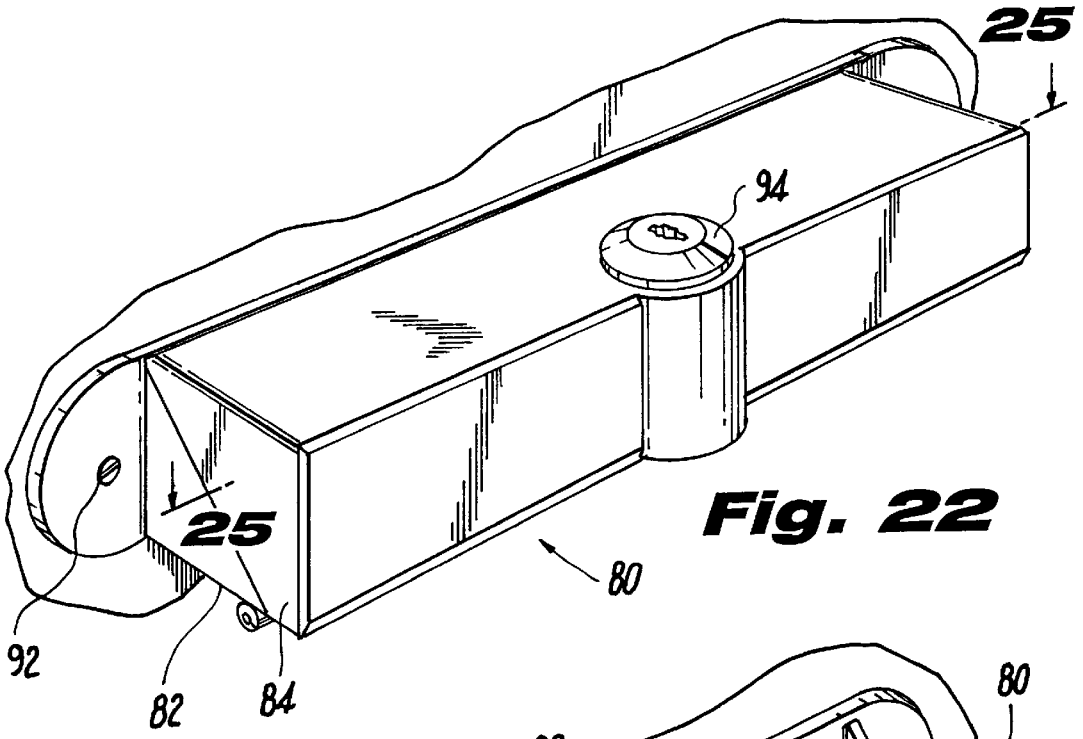
FIG. 22 is a perspective view of the tool.

Referring now to FIGS. 13, 14 and 21, four spring-biased pawls 60 are pivotally connected to latch 52 about pivot pins 62. Each pawl 60 is biased by a spring 64 into a first pawl position, as illustrated in FIG. 13, and is displaceable into a second pawl position, against the force of spring 64. In the second pawl position, one end 66 of pawl 60 is displaced into housing portion 68 of latch 52 so that end 66 of pawl 60 would be hidden from view in FIG. 13. As illustrated in FIG. 14, the housing portion having a vertically oriented rectangular shaped opening (which will be described in further detail below) preferably has two spring-biased pawls 60 as an extra safety feature to prevent unauthorized opening of lid 14. Referring now to FIGS. 15 and 21, locking plate 54 includes at least one recessed shoulder 70 disposed therein. In the first pawl position, end 66 of pawl 60 engages with shoulder 70 to prevent latch 52 from sliding from the first latch position to the second latch position, which therefore, prevents locking plate 54 from sliding from the first locking plate position to the second locking plate position (see FIG. 21).

Locking plate 54 also includes a pair of angled through-slots 72. Latch 52 includes a pair of post projections 74 that are slidably received in slots 72. Slot 72 extends at an angle with respect to both the A and B axes. In a preferred embodiment, slot 72 extends at an angle of approximately 45° with respect to both the A and B axes. One end of each slot 72 has an undercut shoulder 73 projecting into slot 72. Shoulders 73 act as a stop to limit the movement of post projections 74 in slots 72.

Housing portions 68 of latch 52 project through the through opening 44 in lid 14, as illustrated in FIG. 1. Housing portions 68 each have a key opening 76, as illustrated in FIG. 1. Key openings 76 do not necessarily have to have the same shape. For example, one opening 76 may be rectangular-shaped in a vertical orientation, another opening may be circular in shape and a third opening may be rectangular-shaped in a horizontal orientation. Of course, the openings may be of other shapes, such as, for example, square-shaped, triangular-shaped, etc. As discussed above, spring-biased pawls 60 are disposed in housing portions 68 of latch 52. As illustrated in phantom in FIG. 13 and in solid lines in FIG. 21, an end 78 of pawl 60, which is opposite end 66, is disposed within housing portion 68 and is accessible by a tool 80 through key openings 76.

Figure 23:
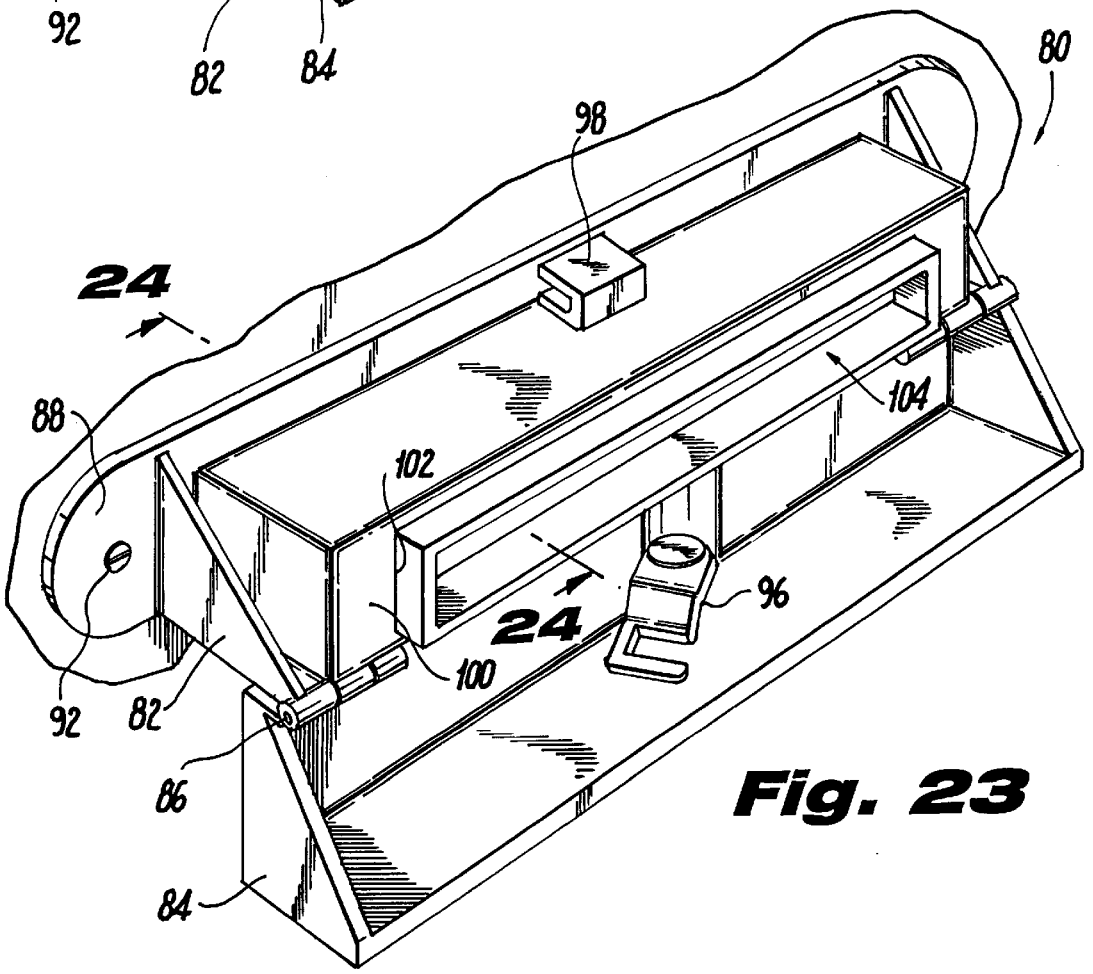
FIG. 23 is a perspective view of the tool in the open, accessible position.
Figure 24:
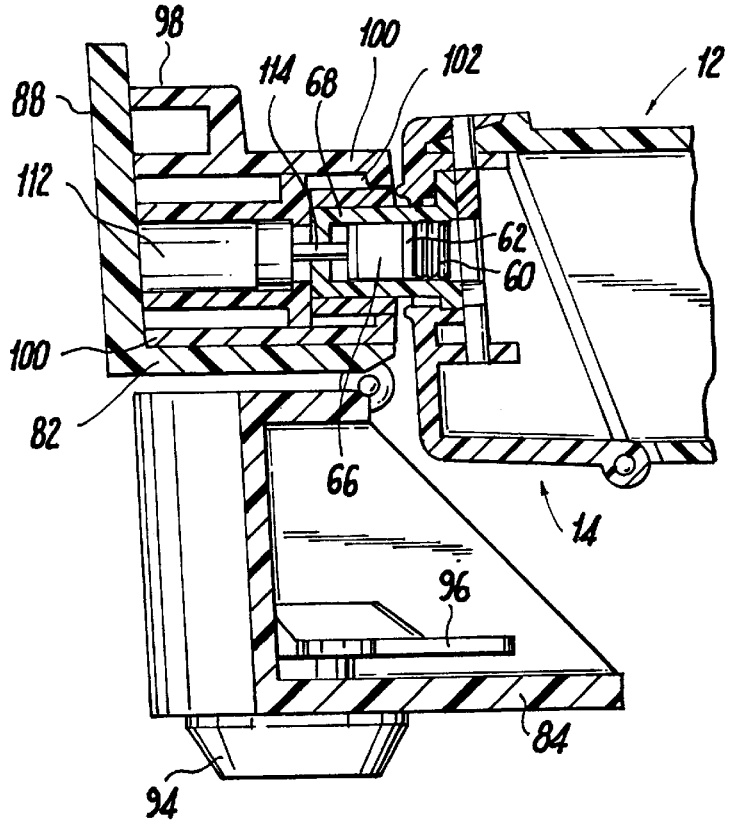
FIG. 24 is a cross-sectional view taken along lines 24—24 of FIG. 23 and looking in the direction of the arrows.
Figure 25:
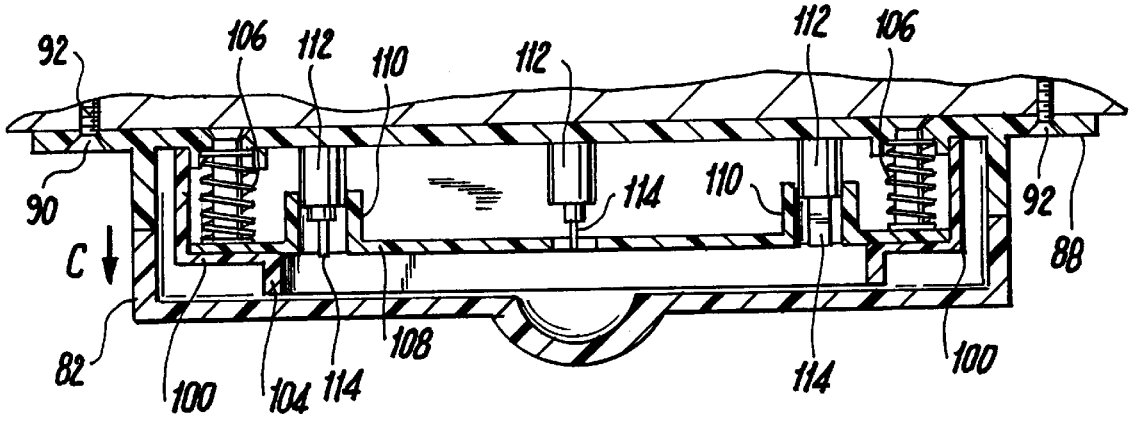
FIG. 25 is a cross-sectional view taken along lines 25—25 of FIG. 22 and looking in the direction of the arrows.

Referring now to FIGS. 22–25, tool 80 is comprised of a first housing portion 82 and a second housing portion 84 that are pivotally connected together by pivot pins 86. First housing portion 82 has a flange wall 88 that has a pair of throughbores 90 so that tool 80 may be fixedly mounted on a planar wall surface, for example, adjacent to a cashier in a retail store, by threaded fasteners 92. Tool 80 may be locked in the closed position illustrated in FIG. 22 by a conventional lock cylinder 94. A key (not shown) may be inserted into cylinder 94 to pivot latch 96 out of engagement from a U-shaped locking channel 98, thereby unlocking tool 80. Second housing portion 84 is now free to be pivoted to the open, accessible position, as shown in FIGS. 23–25.

First housing portion 82 includes a box-shaped housing 100 that is fixedly connected to flange wall 88. Box-shaped housing 100 has a rectangular-shaped opening 102 that is shaped to receive a correspondingly rectangular-shaped slidable housing 104. Housing 104 is biased in the direction indicated by arrow C in FIG. 25 by a pair of springs 106. A rear wall 108 of housing 104 is guided for movement in the direction indicated by arrow C by integral guide sleeves 110. Sleeves 110 surround a respective post 112, which project from flange wall 88. A distal end of each post 112 is formed as a key-shaped projection 114. Projections 114 are shaped in cross-section to match the cross-sectional shape of openings 76 in housing portion 68 of latch 52. In a currently preferred embodiment, one projection 114 has a rectangular-shape in a vertical-orientation, another projection 114 is circular in shape and a is third projection 114 has a rectangular shape in a horizontal orientation.

To open the locked lid/case assembly, tool 80 is first pivoted to the open position as illustrated in FIG. 23. Thereafter, the locked lid/case assembly is positioned so that housing portions 68 are received within the opening defined by housing 104. The rectangular-shaped opening defined by housing 104 is shaped to snugly receive the outer dimensions of housing portions 68 of latch 52. Once housing portion 68 has been placed within housing portion 104, the locked lid/case assembly is further pushed into box-shaped housing 100, thereby causing housing 104 to displace inwardly into box-shaped housing 100 against the spring biasing force caused by springs 106, as shown in FIG. 24. Because post 112 is fixedly connected to flange wall 88, each projection 114 enters into the respective key opening 76 in housing portion 68 of latch 52.

By inserting the tool's key-shaped projections 114 into the respective key openings 76, the tool engages end 78 of each pawl 60 and further insertion of the tool into housing portions 68 causes each pawl 60 to pivot in the counter-clockwise direction, as illustrated in FIG. 13, against the force of spring 64, to displace the pawl from the first pawl position to the second pawl position. In the second pawl position, pawl end 66 no longer engages with recessed shoulder 70 of locking plate 54 so that latch 52 is now free to slide between the first latch position and the second latch position. Latch 52 may be moved from the first latch position to the second latch position, for example, by manual movement of lid 14 with respect to tool 80. This movement causes latch 52 to move from the first latch position to the second latch position, which movement causes pin projections 74 to slide in angle ramps 72 in locking plate 54. Because guide pins 58 of locking plate 54 are received within guide openings 50 in lid 14, locking plate 54 may only move in the direction indicated by arrow B. Therefore, movement of latch 52 in the direction to the second latch position (i.e., to the right, as illustrated in FIG. 14), causes locking plate 54 to move in the downward direction (with reference to FIG. 15) to the second locking plate position. In the second locking plate position, pins 56 are removed from openings 28 in case 12, thereby permitting lid 14 to pivot between the first open position and the second closed position.

Having described the presently preferred exemplary embodiment of a security case in accordance with the present invention, it is believed that other modifications, variations and changes will be suggested to those skilled in the art in view of the teachings set forth herein. It is, therefore, to be understood that all such modifications, variations, and changes are believed to fall within the scope of the present invention as defined by the appended claims.

What is claimed is:

1. A security device comprising:

a case having at least one through opening;

a lid pivotably connected to said case, said lid pivoting between a first open position and a second closed position, said lid having at least one corresponding through opening, in said second closed position, said at least one corresponding through opening in said lid aligning with said at least one through opening in said case;

a latch slidably engaged with said lid, said latch being slidable along a first axis between a first latch position and a second latch position;

a locking plate slidably engaged with said lid, said locking plate being slidable along a second axis between a first locking plate position and a second locking plate position, said locking plate having at least one pin extending along said second axis; and wherein, in said first locking plate position, said at least one pin extends through said aligned at least one opening in said case and said at least one opening in said lid to lock said lid in said second closed position;

in said second locking plate position, said at least one pin being removed from said aligned at least one opening in said case, thereby permitting said lid to pivot between said first open position and said second closed position;

wherein said lid includes a second through opening, a first portion, a second portion and a third portion of said latch projecting through said second through opening, each of said portions of said latch having a key opening, at least three spring biased pawls being pivotally connected to said latch, each of said at least three pawls being biased by said respective spring into a first pawl position and being displaceable into a second pawl position, and said at least three spring biased pawls being disposed such that at least one pawl is disposed in each of said portions of said latch, each of said at least three spring biased pawls being accessible by a tool through said respective key opening to displace said at least three pawls from said first pawl position into said second pawl position.

2. The security device according to claim 1, wherein said first axis is substantially perpendicular to said second axis.

3. The security device according to claim 1, wherein said lid includes a guide channel, said locking plate includes a guide pin extending along said second axis, and said guide pin being slidably received in said guide channel.

4. The security device according to claim 3, wherein said locking plate includes a slot, said latch includes a projection slidably received in said slot.

5. The security device according to claim 4, wherein said slot extends at an acute angle with respect to said first and second axis.

6. The security device according to claim 5, wherein said acute angle is approximately 45°.

7. The security device according to claim 1, wherein said locking plate includes at least one shoulder, in said first pawl position, said at least one pawl engages with said at least one shoulder to prevent said locking plate from sliding from said first locking plate position to said second locking plate position.

8. The security device according to claim 7, wherein said lid includes a guide channel, said locking plate includes a guide pin extending along said second axis, said guide pin being slidably received in said guide channel.

9. The security device according to claim 8, wherein said locking plate includes a slot, said latch includes a projection slidably received in said slot.

10. The security device according to claim 9, wherein said slot extends at an acute angle with respect to said first and second axis.

* * * * *